United States Patent [19]

Funck

[11] Patent Number: 4,761,845

[45] Date of Patent: Aug. 9, 1988

[54] BONDING PRESS FOR SHOES

[76] Inventor: Herbert Funck, Am Wasserbogen 43, D-8032 Gräfelfing-Lochham, Fed. Rep. of Germany

[21] Appl. No.: 1,395

[22] Filed: Jan. 8, 1987

[30] Foreign Application Priority Data

Jan. 14, 1986 [DE] Fed. Rep. of Germany ..... 3600844

[51] Int. Cl.[4] ..... A43D 25/06

[52] U.S. Cl. ..... 12/33; 12/38

[58] Field of Search ..... 12/33, 38, 142 RS, 142 T; 100/272

[56] References Cited

U.S. PATENT DOCUMENTS

| | | | |
|---|---|---|---|
| 1,337,532 | 4/1920 | Stuart | 12/33 |
| 1,487,178 | 3/1924 | Polleys | 12/33 |
| 1,494,706 | 5/1924 | Polleys | 12/33 |
| 2,740,143 | 4/1956 | Frieri | 12/33 |
| 4,628,559 | 12/1986 | Funck | 12/38 |

FOREIGN PATENT DOCUMENTS

| | | | |
|---|---|---|---|
| 2503381 | 7/1976 | Fed. Rep. of Germany . | |
| 2548943 | 5/1977 | Fed. Rep. of Germany . | |
| 2525877 | 11/1983 | France | 12/38 |
| 7600520 | 7/1976 | Netherlands | 12/33 |

*Primary Examiner*—Steven N. Meyers

*Attorney, Agent, or Firm*—Baker, Maxham & Jester

[57] ABSTRACT

A bonding press for cementing shoe soles to lasted uppers. A shoe support plate has an opening to receive the lasted shoe upper with the sole placed thereon. The lasted shoe upper is supported on a last support. A rigid press hood closed on the underside by a soft membrane, is selectively movable to a position to apply pressure to the sole in place on the upper. A control system has switching members for moving, releasing and filling the press hood with compressed air and venting the same. The control system also includes a switching valve adapted to be actuated by insertion of the shoe in the opening formed in the shoe support. The actuators and other elements of the system for controlling the movable press components are controlled by programmable control unit.

22 Claims, 2 Drawing Sheets

BONDING PRESS FOR SHOES

FIELD OF THE INVENTION

The invention is directed generally to a bonding press for bonding shoe soles to lasted uppers, and more particularly to an automated bonding press readily adaptable to various shoe sizes and types, the control unit being activated by insertion of the upper into the press.

BACKGROUND OF THE INVENTION

A bonding press for cementing soles to the underside of lasted uppers of the general type of this invention is shown in German patent publication No. 2,503,381. That bonding press has means for supporting the upper and a press hood which is movable relative to the shoe support and includes fittings for introducing and venting a pressurized medium. The dimensionally stable press hood, which is coupled to drive means, is hermetically sealed on the underside by a circumferentially fixed soft membrane. Upon introduction of the pressure medium the membrane moves into engagement about the portion of the upper which includes the sole and extends into the free space and produces the requisite bonding pressure. In the vicinity of the opening of the shoe support an energizing switch is provided which upon insertion of the upper into the shoe support is actuated and energizes the drive means for moving the press hood. Furthermore, a switch is disposed in the bonding press for actuation by the press hood when the latter is moved to the closed position and for energizing the further switching members of the bonding press control unit. Among the other members energized on motion of the press hood are a check valve for introducing the pressurized medium into the press hood and a timing element for establishing a predetermined bonding time.

A similar bonding press for shoes comprising a laterally pivotable shoe support and switching elements for automatic control of the various movements and bonding operations is shown in German Pat. No. 2,548,943.

In manufacturing systems for making shoes, endeavors have been made in recent years toward maximum automation and increased flexibility of the various processing operations so as to permit the manufacture of different types of shoes with a minimum of manual interference in the manufacturing process. However, with known shoe bonding presses of the above-specified kind the desirable high degrees of automation cannot be achieved. Upon a change of the product series, for instance from men's walking shoes to children's or ladies' shoes or from PUR-soles to leather or rubber soles, each bonding press must be separately adapted to the respective new operating parameters. The necessary changes result in considerable expenditure of labor and time. Moreover, the possible adaptations of such known bonding presses, for instance in respect of size and shape of the insertion openings in the shoe supports or the height and position of the last support, are limited, which reduces the possibility of universal suitability of such a bonding press for greatly differing types of shoes. For this reason it is not readily possible to integrate such bonding presses in flexible manufacturing systems.

SUMMARY OF THE INVENTION

It is an object of the invention to provide a bonding press for shoes which operates with a higher degree of automation and can be adapted to changing product series with little or no manual interference, so that it may possibly also be integrated in flexible manufacturing systems.

In accordance with the invention this object is solved in that the actuators of the movable parts and the switching members of the pressurized fluid system are connected to a control unit adapted to be programmed either manually or by way of data carriers.

A major advantage of the bonding press of the invention resides in the ready automatic and rapid adaptation of its functional components to varying operating parameters, for instance changing from one type of shoe to another or changing of bonding conditions, or both. For an adaptation to the fresh conditions it is then merely necessary to input the new parameters to the programmable control unit either manually or through a data carrier such as a magnetic tape, a punched tape or the like, whereupon the respective optimum control data are computed in the control unit and supplied as control signals to the various actuators and switching members. The programmable control unit typically includes a microprocessor programmed as indicated above. It is thereby possible to integrate one or several bonding presses in a manufacturing system composed of different processing machines and automatic manipulators or loading devices, respectively, and to cause the central processor to make the required adaptations upon a change of the bonding conditions or of the types of shoes.

In consequent further pursuance of the specified aims, preferred embodiments of the invention are characterized by the feature that powered actuators are allocated to each of the bonding press components which must be adjustable for proper functioning thereof, the powered actuators being controlled by the programmable control unit. This applies not only to the press hood and its switching members but in particular also to the shoe supports and the last supports, whose respective locations and positions can be motor-adjusted by separate actuators. In accordance with a suitable improvement of the invention, the last supports which so far could only be height-adjusted by hand, have means associated therewith for permitting motor-driven adjustment of the last support not only in vertical but also in horizontal direction. For such automatic adjustments of the last support, crosswise linear drive mechanisms with recirculating ball screws have proven especially suitable. These drive mechanisms may be driven through stepping motors or other cyclic advancing systems or through pneumatic cylinders, respectively, and permit extremely fine adjustment of height and position in the horizontal plane of the last support.

A further embodiment of the invention, which is especially suitable for universal use of the bonding press, comprises a magazine storage in which several different shoe supports are disposed which, by means of suitable changing mean, can selectively be mounted in and dismounted from the bonding press. Suitably, this magazine contains a vertically movable rack in the various tiers of which the plate-like shoe supports are stored. By actuation of corresponding linear drive mechanisms a tier preselected in the program can be brought into horizontal alignment with the supporting table of the bonding press, whereupon the shoe support previously disposed on the table is moved by means of a horizontal linear drive mechanism into the rack and after a corresponding vertical movement of the rack a fresh shoe support is mounted in the bonding press.

BRIEF DESCRIPTION OF THE DRAWING

The objects, advantages and features of the invention will be more readily perceived from the following detailed description when read in conjunction with the accompanying drawing, in which.

DESCRIPTION OF THE PREFERRED EMBODIMENTS

Figure 1:
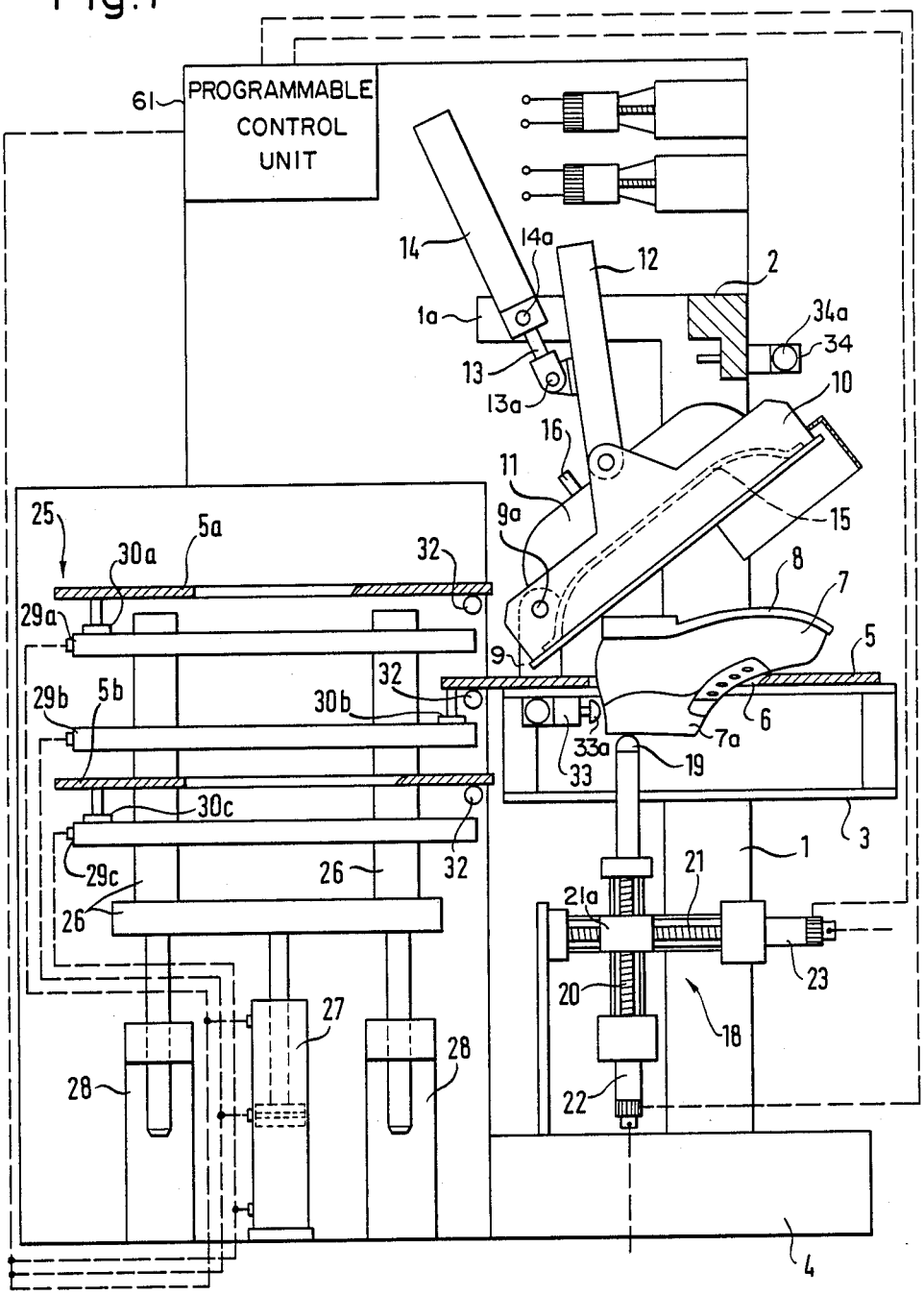
FIG. 1 is a schematic, partially sectional side view of the bonding press of the invention with motor-adjustable shoe support and last support and with a shoe support magazine.

The illustrated bonding press comprises two laterally spaced columns 1 which are rigidly connected to each other through upper cross member 2, a table 3 disposed approximately at reaching level of the hands, and a lower pedestal 4. Downwardly open rack-like table 3 is used to retain and fix a plate-like shoe support 5. The shoe support is formed with a central opening 6 which may be formed with a peripheral bead. Opening 6 is adapted to receive lasted upper 7 which is inserted with the sole 8 loosely placed thereon. The sole is preferably coated with an adhesive before being placed in the press. At the rear end of table 3 two bearing lugs 9 are mounted, laterally spaced from shoe support 5. The bearing lugs pivotably support rigid frame 10 of press hood 11 by suitable means such as cross bolts 9*a*. Frame 10, which surrounds the sides of press hood 11 proper, is pivotably engaged by two levers 12 which are pivotably connected via cross members 13*a* to piston rod 13 of pneumatic cylinder 14. Cylinder 14 is pivotally connected to lateral arm 1*a* of the columns 1 by cross member 14*a*. Hood 11, which may be fabricated from light metal, is closed on the underside thereof by membrane 15, the rim of which is continuously releasably clamped between the hood and the hood frame. Compressed air supply to the closed interior of the press hood, as well as venting, are accomplished through fitting 16.

Adjusting device 18 is mounted on pedestal 4 between the two columns for adjusting height and position of last support 19 so that it may be adapted to the respective shape of last 7*a* carrying upper 7. Adjusting device 18 comprises two crossed recirculating ball screws 20, 21, each including a respective cyclically controlled motor 22, 23. Horizontal recirculating ball screw 21 is fixedly mounted with respect to column 1 and pedestal 4. Vertical recirculating ball screw 20, together with its motor 22, is mounted to clutch 21*a* on screw 21 such that upon rotation of screw 21 last support 19 is displaced horizontally as viewed in the drawing plane. By actuation of motor 22 last support 19 is adjusted vertically.

At the rear of the bonding press is provided magazine 25 for several shoe supports 5*a*, 5*b*. Magazine 25 includes rack 26, represented by horizontal and vertical members. By means of linear drive mechanism 27, such as a pneumatic cylinder, rack 26 is adjustable in vertical direction and is guided in guide posts 28. In the illustrated embodiment, three piston rod-less pneumatic linear drive mechanisms 29*a*, 29*b*, 29*c* are horizontally provided in rack 26, each including a horizontally movable support member 30*a*, 30*b*, 30*c* coupled to a respective one of the plate-like shoe supports 5*a*, 5*b*, 5*c*. For further longitudinally movable guides of the shoe supports, rollers 32 are provided at the front of the magazine.

Figure 2:
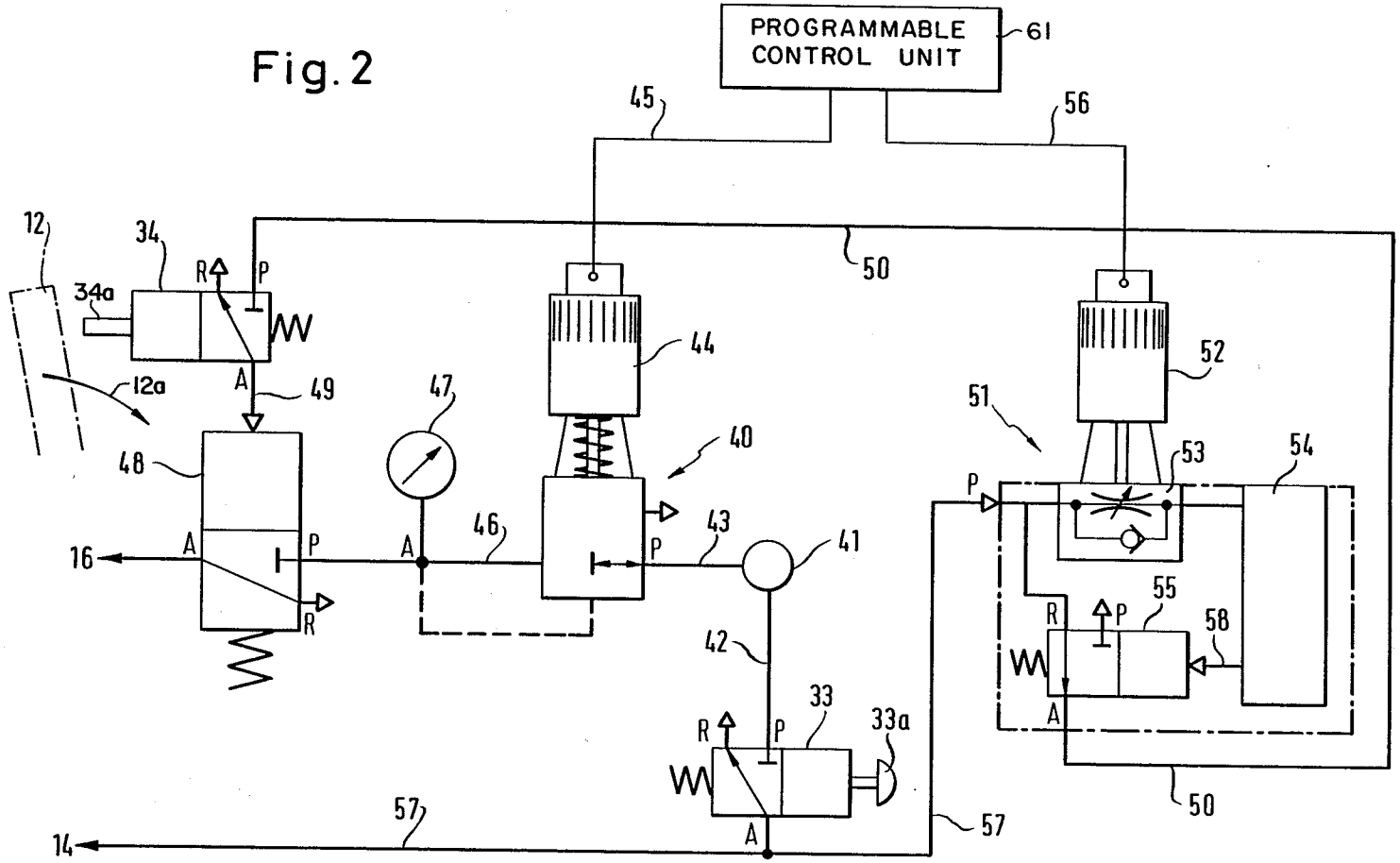
FIG. 2 schematically illustrates an electro-pneumatic control circuit for the bonding press of FIG. 1.

Shoe switching valve 33 is mounted to table 3 directly adjacent opening 6 in shoe support 5, the switch being actuated upon insertion of upper 7 into central opening 6 to thereby activate the pressure fluid circuit through the central processing unit illustrated in FIG. 2. Locking valve 34 has a similar function. It is disposed in the vicinity of upper cross member 2 and is actuated by lever 12 when it pivots to its locking position. A pressurized medium can be supplied to press hood 11 through fitting 16 only when levers 12 have pivoted inwardly into recesses in cross member 2, fully closing the press hood and simultaneously actuating switch 34*a* of valve 34.

FIG. 2 illustrates a pneumatic circuit comprising the switching members and actuators functionally necessary for performing bonding operations. Shoe switch 33 and pressure regulator 40 are connected by conduits 42, 43 to compressed-air supply line 41. Pressure regulator 40 includes a stepping motor 44 which is connected through conductor 45 to programmable central control unit 61. The stepping motor rotates the pressure regulator spindle in response to the signals obtained from the control unit to thereby set a respective desired pressure in output line 46. This pressure in the output line is indicated by element 47 which may be an analog or digital pressure gauge, as illustrated, and may be disposed at a suitable location in the bonding press. Alternatively, the indicator may be an electronic indicator element mounted in a control console (not illustrated). The output pressure set in this way constitutes the working pressure in the press hood. Change-over valve 48 is connected between line 46 and fitting 16 of the press hood. In its first position valve 48 permits compressed air to flow into the press hood while in its second position it blocks the feed and discharge lines. The change-over valve communicates the interior of the press hood to the atmosphere for venting purposes in the third position.

In the embodiment illustrated, valve 48 is pneumatically controlled, the control pressure being supplied by control line 49 from locking valve 34 which is actuated when lever 12 is pivoted to its locking position. Control pressure line 50 connects locking valve 34 to combination control unit 51 which comprises a one-way restrictor 53 having a variable orifice controlled by stepping motor 52, pressure accumulator 54 and switching valve 55. Stepping motor 52 is connected by line 56 to programmable central control unit 61. Pressure fluid line 57 extends from one side of shoe switching valve 33 to cylinder 14 for moving the press hood 10, 11 and from the other side to combination control element 51.

Operation of the illustrated control circuit will now be detailed. Upon insertion of upper 7, including sole 8, into opening 6 of shoe support 5, switch 33a of shoe valve 33 is actuated so that working pressure flows from supply line 1 through valve 33 into cylinder 14 to initiate the movement of the previously open press hood. Simultaneously, the working pressure is also applied via line 57 to control element 51. Through an internal branch line that pressure flows through switching valve 55, which has the illustrated position, and through control line 50 to the still blocked input of locking valve 34. Only when lever 12, which is pivoted by extension of piston rod 14 in the direction of arrow 12*a*, has reached its locking position and locking valve 34 has been switched, can compressed air from control line 50 be applied to change-over valve 48. At that time valve 48 is switched from the position shown in FIG. 2 and communicates the interior of press hood 11 to output line 46 from pressure regulator 40. Working pressure is then built up in the firmly closed press hood. The time period within which this pressure build-up in the press hood takes place is determined by control element 51 whose components 53, 54 function as a timer. In pressure accumulator 54 the pressure will build up only progressively in response to the flow rate through variable orifice 53. As soon as a predetermined control pressure has been reached in accumulator 54, which via internal connection 58 acts on switching valve 55, the latter will be switched and will vent the control space of change-over valve 48 through line 50 and locking valve 34, the change-over valve changing to its central blocking position.

Programmable control unit 61 preferably includes a microprocessor. To change operation of the bonding press to accommodate new conditions (size or style of shoe for example) it is merely necessary to reprogram the microprocessor with new parameters. This can be done either directly or manually or by means of a data carrier such as magnetic tape, punched tape or the like. Optimum control data are then recomputed, resulting in modified control signals to be supplied to the actuators and switching members.

The electro-pneumatic control system shown in FIG. 2 comprises, instead of a pneumatically pilot-controlled large-size pressure regulator, three-way/two-way valve 48 which is directly controlled by regulator 40. Two timing valves may be used for controlling the closing period of the press hood and the pressing period proper. But since in practical use the closing and venting or opening ties of the press hood are very short and remain constant, the use of a single timing element for the pressing period including the nonproductive times is normally sufficient.

In view of the above description, it is likely that modifications and improvements will occur to those skilled in the relevant art which are within the scope of the appended claims.

What is claimed is:

1. A bonding press for cementing shoe soles to lasted uppers, said bonding press comprising:

a frame;

a supporting table mounted to said frame;

a shoe support formed with a central opening adapted to receive a lasted upper within a predetermined size range, said shoe support selectively residing on said supporting table;

last support means on said frame adjustably supporting the lasted upper in said central opening;

press hood means comprising a relatively rigid concave shell member and a pliable membrane enclosing the open side of said shell member thereby forming an interior cavity, said press hood means being pivotably mounted to said frame;

control circuit means having actuators for moving, releasing and selectively filling and venting said press hood means with compressed air, said control circuit means comprising a switching valve adapted to be automatically actuated upon insertion of the lasted upper in said central opening in said shoe support, said control circuit means being operatively coupled to the movable components of said bonding press; and a programmable control unit connected to said control circuit means so as to control operation of said movable components and said actuators;

said last support means being horizontally and vertically movable with respect to said shoe support by position adjusting actuating means controlled by said programmable control unit.

2. A bonding press for cementing shoe soles to lasted uppers, said bonding press comprising:

a frame;

a shoe support formed with a central opening adapted to a shoe support formed with a central opening adapted to receive a lasted upper within a predetermined size range, said shoe support selectively residing on said supporting table;

last support means on said frame adjustably supporting the lasted upper in said central opening;

press hood means comprising a relatively rigid concave shell member and a pliable membrane enclosing the open side of said shell member thereby forming an interior cavity, said press hood means being pivotably mounted to said frame;

control circuit means having actuators for moving, releasing and selectively filling and venting said press hood means with compressed air, said control circuit means comprising a switching valve adapted to be automatically actuated upon insertion of the lasted upper in said central opening in said shoe support, said control circuit means being operatively coupled to the movable components of said bonding press, said control circuit means further comprising:

a switching member coupled to the interior of said press hood means for selectively filling and venting said interior cavity;

a pressure regulator coupled to said switching member for controlling the pressure applied to said interior cavity; and a variable timing element coupled between said pressure regulator and said switching member; and a programmable control unit connected to said control circuit means so as to control operation of said movable components and said actuators;

said last support means being horizontally and vertically movable with respect to said shoe support by position adjusting actuating means controlled by said programmable control unit.

3. The bonding press recited in either claim 1 or 2, wherein said shoe support is horizontally movable with respect to said frame by means of an associated movable support member, the motion of which is controlled by said programmable control unit.

4. The bonding press recited in either claim 1 or 2, wherein said shoe support is removably and replaceably coupled to said frame, the motion of which is controlled by said programmable control unit.

5. The bonding press recited in claim 4, and further comprising:

magazine means having a plurality of shoe supports adapted to be selectively coupled to said frame, said shoe supports having different size central openings;

means for vertically moving said shoe supports in said magazine means with respect to said frame; and means for moving a selected shoe support between said magazine means and said frame.

6. The bonding press recited in claim 1 or 2 wherein said position adjusting actuating means comprises crossed recirculating ball screws and respective motor means coupled to said programmable control unit.

7. The bonding press recited in claim 6, wherein said shoe support is horizontally movable with respect to said frame by means of an associated movable support member, the motion of which is controlled by said programmable control unit.

8. The bonding press recited in claim 6, wherein said shoe support is removably and replaceably coupled to said frame, the motion of which is controlled by said programmable control unit.

9. The bonding press recited in claim 8, and further comprising:

magazine means having a plurality of shoe supports adapted to be selectively coupled to said frame, said shoe supports having different size central openings;

means for vertically moving said shoe supports in said magazine means with respect to said frame; and means for moving a selected shoe support between said magazine means and said frame.

10. The bonding press recited in claim 3, wherein said shoe support is removably and replaceably coupled to said frame, the motion of which is controlled by said programmable control unit.

11. The bonding press recited in claim 10, and further comprising:

magazine means having a plurality of shoe supports adapted to be selectively coupled to said frame, said shoe supports having different size central openings;

means for vertically moving said shoe supports in said magazine means with respect to said frame; and means for moving a selected shoe support between said magazine means and said frame.

12. A bonding press for cementing shoe soles to lasted uppers, said bonding press comprising:

a frame;

a supporting table mounted to said frame;

a shoe support formed with a central opening adapted to receive a lasted upper within a predetermined size range, said shoe support selectively residing on said supporting table and being removably and replaceably coupled to said frame;

last support means on said frame adjustably supporting the lasted upper in said central opening;

magazine means having a plurality of shoe supports adapted to be selectively coupled to said frame, said shoe supports having different size central openings;

means for vertically moving said shoe supports in said magazine means with respect to said frame;

means for moving a selected shoe support between said magazine means and said frame;

press hood means comprising a relatively rigid concave shell member and a pliable membrane enclosing the open side of said shell member thereby forming an interior cavity, said press hood means being pivotably mounted to said frame;

control circuit means having actuators for moving, releasing and selectively filling and venting said press hood means with compressed air, said control circuit means comprising a switching valve adapted to be automatically actuated upon insertion of the lasted upper in said central opening in said shoe support, said control circuit means being operatively coupled to the movable components of said bonding press; and a programmable control unit connected to said control circuit means so as to control operation of said movable components and said actuators;

the motion of said shoe support with respect to said frame being controlled by said programmable control unit.

13. The bonding press recited in claim 12, wherein said control circuit means comprises:

a switching member coupled to the interior of said press hood means for selectively filling and venting said interior cavity;

a pressure regulator coupled to said switching member for controlling the pressure applied to said interior cavity; and a variable timing element coupled between said pressure regulator and said switching member.

14. The bonding press recited in either claim 12 or 13 wherein said shoe support is horizontally movable with respect to said frame by means of an associated movable support member, the motion of which is controlled by said programmable control unit.

15. A bonding press for cementing shoe soles to lasted uppers, said bonding press comprising:

a frame;

a supporting table mounted to said frame;

a shoe support formed with a central opening adapted to receive a lasted upper within a predetermined size range, said shoe support selectively residing on said supporting table;

last support means on said frame adjustably supporting the lasted upper in said central opening;

press hood means comprising a relatively rigid concave shell member and a pliable membrane enclosing the open side of said shell member thereby forming an interior cavity, said press hood means being pivotably mounted to said frame;

control circuit means having actuators for moving, releasing and selectively filling and venting said press hood means with compressed air, said control circuit means comprising a switching valve adapted to be automatically actuated upon insertion of the lasted upper in said central opening in said shoe support, said control circuit means being operatively coupled to the movable components of said bonding press; and a programmable control unit connected to said control circuit means so as to control operation of said movable components and said actuators;

said last support means being horizontally and vertically moveable with respect to said shoe support by position adjusting actuating means controlled by said programmable control unit, said position adjusting actuating means comprising crossed recirculating ball screws and respective motor means coupled to said programmable control units;

said shoe support being horizontally moveable with respect to said frame by means of an associated moveable support member, the motion of which is controlled by said programmable control unit.

16. The bonding press recited in claim 15 wherein said control circuit means comprises:

a switching member coupled to the interior of said press hood means for selectively filling and venting said interior cavity.

a pressure regulator coupled to said switching member for controlling the pressure applied to said interior cavity; and a variable timing element coupled between said pressure regulator and said switching member.

17. The bonding press recited in claim 16 wherein said last support means is horizontally and vertically movable with respect to said shoe support by position adjusting actuating means controlled by said programmable control unit.

18. The bonding press recited in claim 15 or 16, wherein said shoe support is removably and replaceably coupled to said frame, the motion of which is controlled by said programmable control unit.

19. The bonding press recited in either claim 15 or 13 wherein said shoe support is removably and replaceably coupled to said frame, the motion of which is controlled by said programmable control unit.

20. The bonding press recited in claim 19 and further comprising:

magazine means having a plurality of shoe supports adapted to be selectively coupled to said frame, said shoe supports having different size central openings;

means for vertically moving said shoe supports in said magazine means with respect to said frame; and means for moving a selected shoe support between said magazine means and said frame.

21. The bonding press recited in claim 15, said control circuit means further comprising indicator means to show output pressure.

22. The bonding press recited in either claim 15 or 21, wherein said programmable control unit comprises a microprocessor adapted to be programmed either manually or by means of a data carrier.

* * * * *